United States Patent [19]

Derbyshire et al.

[11] 4,292,168

[45] Sep. 29, 1981

[54] UPGRADING HEAVY OILS BY NON-CATALYTIC TREATMENT WITH HYDROGEN AND HYDROGEN TRANSFER SOLVENT

[75] Inventors: Francis J. Derbyshire, Lawrenceville; Thomas O. Mitchell, Trenton; Darrell D. Whitehurst, Titusville, all of N.J.

[73] Assignee: Mobil Oil Corporation, New York, N.Y.

[21] Appl. No.: 107,949

[22] Filed: Dec. 28, 1979

[51] Int. Cl.[3] ..... C10G 9/14; C10G 47/34

[52] U.S. Cl. ..... 208/107; 208/8 LE; 208/56; 208/145

[58] Field of Search ..... 208/107, 145, 56, 8 LE

[56] References Cited

U.S. PATENT DOCUMENTS

| | | | |
|---|---|---|---|
| 2,772,213 | 11/1956 | Fischer | 208/56 |
| 2,953,513 | 9/1960 | Langer | 208/56 |
| 4,002,556 | 1/1977 | Satchell | 208/107 |
| 4,090,947 | 5/1978 | Satchell | 208/56 |
| 4,115,246 | 9/1978 | Sweany | 208/56 |
| 4,151,066 | 4/1979 | Yan et al. | 208/8 LE |

*Primary Examiner*—Delbert E. Gantz
*Assistant Examiner*—G. E. Schmitkons
*Attorney, Agent, or Firm*—Charles A. Huggett; James F. Powers, Jr.; Edward J. Trojnar

[57] ABSTRACT

Heavy liquid hydrocarbon oil, such as petroleum derived tars, predominantly boiling over 425° C., are upgraded to products boiling below 425° C., without substantial formation of insoluble char, by heating the heavy oil with hydrogen and a hydrogen transfer solvent in the absence of hydrogenation catalyst at temperatures of about 320° C. to 500° C., and a pressure of 20 to 180 bar for 3 to 30 minutes. The hydrogen transfer solvents are polycyclic compounds free of carbonyl groups, e.g., pyrene, and have a polarographic reduction potential which is less negative than phenanthrene and equal to or more negative than azapyrene.

20 Claims, No Drawings

UPGRADING HEAVY OILS BY NON-CATALYTIC TREATMENT WITH HYDROGEN AND HYDROGEN TRANSFER SOLVENT

CROSS-REFERENCE TO RELATED APPLICATION

An application Ser. No. 055,948 filed July 9, 1979 in the names of Francis J. Derbyshire, Thomas O. Mitchell and Darrell D. Whitehurst discloses a method for the liquefaction of solid carbonaceous materials, e.g., coal, with a hydrogen transfer solvent in the absence of heterogeneous hydrogenation catalyst.

BRIEF SUMMARY OF THE INVENTION

Heavy liquid hydrocarbon oils, such as petroleum derived tars, predominantly boiling over 425° C., are upgraded to products boiling below 425° C., without substantial formation of insoluble char, by heating the heavy oil with hydrogen and a hydrogen transfer solvent in the absence of hydrogenation catalyst at temperatures of about 320° C. to 500° C., and a pressure of 20 to 180 bar for 3 to 30 minutes. The hydrogen transfer solvents are polycyclic compounds free of carbonyl groups and have a polarographic reduction potential which is less negative than phenanthrene and equal to or more negative than azapyrene.

DETAILED DESCRIPTION OF THE INVENTION

The hydrogen donor diluent cracking process (HDCC) in which certain low value hydrocarbon fractions are upgraded by thermal cracking in the presence of a hydrogen donor diluent is described in detail in U.S. Pat. No. 2,953,513. Process variables and operating conditions for the hydrogen donor diluent cracking process are discussed at length in that patent. One disadvantage of the HDCC is that it requires a step of external hydrogenation of the spent hydrogen donor. Hydrogenation is conducted over a suitable catalyst and problems typically arise from catalyst deactivation by coke formation and metal deposition. A hydrogenation catalyst is not necessary in the process of this invention.

U.S. Pat. No. 4,151,066 describes a process for the liquefaction of coal and other solid carbonaceous material, and refers to a number of earlier patents on the subject. This patent is incorporated herein by reference. U.S. Pat. No. 4,151,066 conducts liquefaction of coal in the presence of a solvent which must contain certain proportions of components having a certain "$H_\alpha$ proton content". In particular, the process of the patented invention requires a $H_\alpha$ proton content of at least about 30%. The process does not require the presence of hydrogen, nor does it require a catalyst but is recognized in the art that certain of the inorganic components of coals, and the like, function as hydrogenation catalysts. Hydrogen is disclosed as being optionally present. In contrast, the process of this invention does not at all depend on the presence of inorganic components which function as catalysts nor does it depend on the presence of a solvent having an $H_\alpha$ proton content of at least 30%. Indeed, the solvent of this invention can be entirely devoid of such components. Neither does the presence of solvents having an $H_{60}$ proton content affect the present process. For example, a solvent having an $H_\alpha$ proton content of less than about 25% as measured in U.S. Pat. No. 4,151,066 is entirely suitable for this invention.

In general, the process of this invention is suitable for upgrading a wide variety of heavy liquid hydrocarbon oils, the components of which predominantly boil over 425° C. Included in this class of feeds for the present process are residual fractions obtained by catalytic cracking of gas oils, solvent extracts obtained during the processing of lube oil stocks, asphalt precipitates obtained from deasphalting operations, high boiling bottoms or resids obtained during vacuum distillation of petroleum oils, and the like.

Process conditions can vary widely based on the nature of the heavy oil material, solvent and other factors.

Generally, the process of this invention is conducted at a temperature in the range of 320° C. to 500° C. The temperature selected is sufficient to obtain substantial conversion, e.g., 50% or more of the constituents boiling above 425° C. to products boiling below 425° C. Temperatures in the range of 350° C. to 475° C. have been found to be particularly suitable.

The pressure utilized in the process can also be varied within wide limits sufficient to achieve the degree of conversion desired. For example, the pressure can range from 20 bar to 180 bar. More often, the pressure selected is in the range of 40 bar to 100 bar.

Residence time depends greatly on the components in the reaction, time and temperature. In general, the residence time ranges from 1 to 240 minutes. Preferably, conditions and components are selected so that the residence time is 3 to 60 minutes.

The process of this invention results in high conversions of the heavy oil to distillate components while producing low yields of insoluble materials. For example, conversions of at least about 50% with less than 10% tetrahydrofuran insolubles are desired. Higher conversions have been achieved. Conversion is measured by determining the percent of the product of the reaction which boils below 425° C. and comparing it to the portion of the feed boiling at 425° C. or above. Tetrahydrofuran insolubles are determined by extracting the product for approximately 17 hours (overnight) in a Soxhlet apparatus and determining the percent by weight of the product of reaction which has not been extracted with tetrahydrofuran.

The process of this invention can be conducted batchwise, for example, in an autoclave or in a continuous manner. The process can be conducted by reacting the heavy oil, hydrogen transfer solvent and hydrogen together in a single zone. Alternatively, the heavy oil and hydrogen transfer solvent can be reacted in one zone and the dehydrogenated solvent can be hydrogenated in a separate zone prior to recycling to the reaction zone. In any case, the essential aspect of the invention is that there is no heterogeneous hydrogenation catalyst added at any stage of the process. Nor is there any contact with heterogeneous hydrogenation catalyst such as in the hydrogen donor diluent cracking process (HDCC) in which hydrogen donor solvent used in liquefaction is separated from the product and subjected to a step of hydrogenation in the presence of catalyst prior to being recycled to the liquefaction zone. It is the elimination of the heterogeneous catalyst which is an essential aspect of this invention. Elimination of the catalyst avoids the recognized disadvantages of catalyst use, such as deactivation of the catalyst by coke formation and the deposition of metals.

In order to achieve the efficiency possible with the present process, the constitution of the organic solvent which is used as the heavy oil diluent in the process is of the utmost importance. Suitable solvents are denominated hydrogen transfer solvents and are selected by a polarographic reduction technique described below.

Generally, the hydrogen transfer solvents suitable for use in this invention have a polarographic reduction potential of −1.0 to −2.0 V with reference to a standard calomel electrode. The test is conducted by dissolving the test material in dimethylformamide (5–50 mg/cc) containing 0.2 M tetrabutylammonium bromide and a 10:1 ratio of p-cresol to sample (by weight), the measuring the diffusion current versus voltage. Materials which give a current of at least 1.0 microamperes in the range of −1.0 to −2.0 V and do not contain carbonyl groups are considered suitable hydrogen transfer solvents. More specifically, the hydrogen transfer solvent is selected so that its polarographic reduction potential is less negative than that of phenanthrene and equal to or more negative than that of azapyrene.

Preferably, the hydrogen transfer solvent in its hydrogenated form which meets the polarographic reduction potential test also is easily dehydrogenated under the conditions contemplated in this process. This property is best measured empirically. Examples of materials suitable as hydrogen transfer solvents which are easily thermally hydrogenated and easily thermally dehydrogenated include pyrene, fluoranthene, anthracene, benzanthracene, dibenzanthracene, perylene, coronene, and benzopyrene, as well as their nitrogen analogs such as benzoquinoline, acridine, azapyrene, and their hydrogenated derivatives Quinoline is also suitable as are the lower alkyl analogs of the foregoing materials.

Mixtures of suitable hydrogen transfer solvents can be used as well as mixtures of hydrogen transfer solvents and other solvents which do not qualify under the above-described polarographic reduction potential test. Preferably, the total solvent used to slurry the solid carbonaceous material contains at least 15% by weight of a suitable hydrogen transfer solvent.

While we do not wish to be bound by a particular mechanism, it appears that the hydrogen transfer solvents, which have appropriate polarographic reduction potentials to satisfy the requirements of this invention are capable of being thermally hydrogenated in the absence of hydrogenation catalysts under the temperature and pressure conditions useful in the present invention. It is also believed that the thermal hydrogenation products of the solvents which are selected have the ability of being dehydrogenated or donating hydrogen atoms to free radicals resulting from the depolymerization of constituents in the heavy oil. Thus, this process is believed to depend on the in situ hydrogenation and dehydrogenation of certain organic materials which are selected based on their satisfaction of the desired polarographic reduction potential requirements. It is significant that certain recognized hydrogen donor solvents which are typically hydrogenated with catalysts are not suitable for this invention. For example, naphthalene can be hydrogenated in the presence of catalysts to tetralin which will function as a hydrogen donor. Naphthalene does not meet the requirements of the polarographic reduction potential test by which hydrogen transfer solvents under this invention are selected. Nor is naphthalene effective in the claimed process conducted in the absence of hydrogenated catalysts, apparently because it is not susceptible to thermal hydrogenation in the absence of hydrogenation catalysts under the conditions of the present process. It is also significant that tetralin, the hydrogenated form of naphthalene, does not satisfy the requirements for the solvent under this invention as defined by the polarographic reduction potential test.

The following Examples are further illustrative of the present invention. The reactants and conditions are presented as being typical. Various modifications of the Examples can be made in view of the foregoing disclosure within the scope of the invention.

EXAMPLE 1

Petroleum tar (PD tar) was reacted in an autoclave under various conditions in the absence of extraneous hydrogenation catalyst. PD tar is the propane insoluble portion of the residue produced by vacuum distillation of an Arabian Light Crude. Its properties are summarized in Table 1.

Standard experimental conditions were as follows: average temperature 450° C. for 40 minutes under an initial gas pressure of 55–70 bar with constant agitation. In each case, the reaction products were extracted in tetrahydrofuran (THF) using a Soxhlet apparatus and the quantity of the THF insoluble material was determined. In this system, it was not possible to determine the gas yield accurately and the yield of low boiling distillates was difficult to quantify when using pyrene.

In order to obtain a comparison of the liquid yields, the THF soluble products were examined by thermogravimetric analysis (TGA) to determine the quantities of product boiling above 426° C. This cut point is above the boiling point of pyrene (393° C.) and therefore the high boiling liquids should be derived only from the PD tar. The total yield of liquids boiling below 426° C. and of gaseous products was obtained by difference.

The results of the experiments are summarized in Table 2. Yields are expressed as a percentage of the PD tar feed. Thermal treatment of the tar alone (Run 1) produced a high yield of total product boiling below 426° C. but at the expense of producing 28.5% insoluble product. This insoluble product is effectively a 'char' or 'coke' and commensurate with its formation there was a high yield of light gases. The autoclave pressure in Run 1 increased by over 70 bar compared to about 7 bar increases in the other runs. Approximate calculations indicate that the yield of $C_5$-gases was greater than 20% compared to about 7% in Run 4.

Use of pyrene under argon atmosphere (Run 2) substantially reduced the insolubles yield but also left a high proportion of soluble product boiling above 426° C. However, the combination of pyrene and molecular hydrogen in Runs 3 and 4 further reduced the insolubles yield and increased the total yield boiling below 426° C. to 60%. Approximately 7% of this is light gases, as indicated above, realizing a distillate yield of 53%.

TABLE 1

PROPERTIES OF PD TAR

| Elemental Analysis | % | |
|---|---|---|
| C | 83.71 | |
| H | 9.47 | |
| O | 0.97 | |
| N | 0.37 | |
| S | 4.93 | |
| Ash | 0.12 | |
| Conradson Carbon Residue | | 21.9% |
| Boiling Range | | +425° C. |

TABLE 1-continued

| PROPERTIES OF PD TAR Elemental Analysis | % |
|---|---|
| THF Solubility | 99.99% |

TABLE 2

THERMAL TREATMENT OF PD TAR (450° C., 40 min, 55–70 bar initial pressure, approximate Ratio of Pyrene: tar is 3:1)

| Run No | Diluent | Gas | THF Insolubles | THF Solubles >450° C. | Gas + Solubles <450° C. |
|---|---|---|---|---|---|
| 1 | None | $H_2$ | 28.5 | 17.6 | 53.9 |
| 2 | Pyrene | Ar | 10.6 | 48.5 | 40.9 |
| 3 | Pyrene | $H_2$ | 4.4 | 35.2 | 60.9 |
| 4 | Pyrene | $H_2$ | 2.6 | 37.4 | 60.0 |

We claim:

1. A process for upgrading heavy liquid hydrocarbon oil which comprises the steps of (1) forming a mixture of said heavy liquid hydrocarbon oil, a major fraction of which boils above 425° C., and an organic solvent containing at least 15% by weight of polycyclic hydrogen transfer solvent, said polycyclic hydrogen transfer solvent being free of carbonyl groups and having a polarographic reduction potential which is less negative than phenanthrene and equal to or more negative than azapyrene;

(2) heating said mixture in the substantial absence of heterogeneous hydrogenation catalyst at a temperature under pressure and for a time sufficient to obtain at least 50% conversion of the fraction boiling above 425° C. to products boiling below 425° C. and containing less than 10% by weight of tetrahydrofuran insolubles; and (3) externally hydrogenating said polycyclic hydrogen transfer in the absence of heterogeneous hydrogenation catalyst prior to mixing with the heavy hydrocarbon oil in step (1).

2. A process for upgrading heavy liquid hydrocarbon oil which comprises the steps of (1) forming a mixture of said heavy liquid hydrocarbon oil, a major fraction of which boils above 425° C., and an organic solvent containing at least 15% by weight of polycyclic hydrogen transfer solvent, said polycyclic hydrogen transfer solvent being free of carbonyl groups and having a polarographic reduction potential which is less negative than phenanthrene and equal to or more negative than azapyrene;

(2) heating said mixture with $H_2$ in the substantial absence of heterogeneous hydrogenation catalyst at a temperature, under pressure and for a time sufficient to obtain at least 50% conversion of the fraction boiling above 425° C. to products boiling below 425° C. and containing less than 10% by weight of tetrahydrofuran insolubles; and (3) separating said polycyclic hydrogen transfer solvent from the product of step (2) and recycling it to step (1) without external hydrogenation.

3. The process of claim 1 wherein said hydrogen transfer solvent comprises pyrene, fluoranthene, anthracene, benzanthracene, dibenzanthracene, coronene, perylene, benzopyrene, their heteronitrogen analogs, quinoline or the lower alkyl analogs of the foregoing materials.

4. The process of claim 2 wherein said hydrogen transfer solvent comprises pyrene, fluoranthene, anthracene, benzanthracene, dibenzanthracene, coronene, perylene, benzopyrene, their heteronitrogen analogs, quinoline or the lower alkyl analogs of the foregoing materials.

5. The process of claim 1 wherein heating is conducted at 320° C. to 500° C. under a pressure of 20 to 180 bar for 1 to 240 minutes.

6. The process of claim 2 wherein heating is conducted at 320° C. to 500° C. under a pressure of 20 to 180 bar for 1 to 240 minutes.

7. The process of claim 1 wherein heating is conducted at 350° C. to 475° C., at a pressure of 40 to 100 bar for 3 to 30 minutes.

8. The process of claim 2 wherein heating is conducted at 350° C. to 475° C., at a pressure of 40 to 100 bar for 3 to 30 minutes.

9. The process of claim 1 wherein the weight ratio of the organic solvent to heavy liquid hydrocarbon oil is from 1:1 to 1:5.

10. The process of claim 2 wherein the weight ratio of the organic solvent to heavy liquid hydrocarbon oil is from 1:1 to 1:5.

11. The process of claim 1 wherein the weight ratio of the organic solvent to heavy liquid hydrocarbon oil is 2:1 to 3:1.

12. The process of claim 2 wherein the weight ratio of the organic solvent to heavy liquid hydrocarbon oil is 2:1 to 3:1.

13. The process of claim 1 wherein the heavy liquid hydrocarbon oil is a residue of petroleum distillation.

14. The process of claim 2 wherein the heavy liquid hydrocarbon oil is a residue of petroleum distillation.

15. The process of claim 1 wherein the heavy liquid hydrocarbon oil is in the insoluble product remaining after propane extraction of a petroleum distillation residue.

16. The process of claim 2 wherein the heavy liquid hydrocarbon oil is in the insoluble product remaining after propane extraction of a petroleum distillation residue.

17. The process of claim 1 wherein the organic solvent has an $H_\alpha$ proton content of less than 25%.

18. The process of claim 2 wherein the organic solvent has an $H_\alpha$ proton content of less than 25%.

19. The process of claim 1 wherein the organic solvent has an $H_\alpha$ proton content of less than 10%.

20. The process of claim 2 wherein the organic solvent has an $H_\alpha$ proton content of less than 10%.

* * * * *